US006412190B1

(12) United States Patent
Smith

(10) Patent No.: US 6,412,190 B1
(45) Date of Patent: Jul. 2, 2002

(54) INFRARED AND HOT AIR DRYER COMBINATION

(76) Inventor: Thomas Smith, 1415 Golf Rd., Cinnaminson, NJ (US) 08077

( * ) Notice: Subject to any disclaimer, the term of this patent is extended or adjusted under 35 U.S.C. 154(b) by 0 days.

(21) Appl. No.: 09/859,317

(22) Filed: May 17, 2001

(51) Int. Cl.[7] ..... F26B 7/00; F26B 3/00

(52) U.S. Cl. ..... 34/266; 34/267; 34/271; 34/274; 34/360; 34/420; 34/421; 34/423; 34/430; 34/433; 34/451; 34/508; 34/514; 34/578

(58) Field of Search ..... 34/266, 267, 271, 34/273, 274, 359, 360, 363, 370, 418, 419, 420, 421, 422, 423, 427, 430, 433, 443, 444, 451, 508, 514, 576, 589, 590, 147, 611, 618, 647, 86, 464

(56) References Cited

U.S. PATENT DOCUMENTS 3,720,002 A * 3/1973 Martin ..... 34/18
3,936,951 A * 2/1976 Haueise et al. ..... 34/35
4,257,172 A * 3/1981 Townsend ..... 34/68
4,287,671 A * 9/1981 Koch ..... 34/23
4,312,136 A * 1/1982 Bahner et al. ..... 34/35
4,378,207 A * 3/1983 Smith ..... 432/8
4,443,185 A * 4/1984 Smith ..... 432/59
4,727,655 A * 3/1988 Jacobi ..... 34/4
4,756,091 A * 7/1988 Van Denend ..... 34/4
4,942,674 A * 7/1990 Karlsson ..... 34/18
5,009,016 A * 4/1991 LePisto et al. ..... 34/41
5,090,898 A * 2/1992 Smith ..... 431/326
5,261,166 A * 11/1993 Seeley et al. ..... 34/1
5,263,265 A * 11/1993 Melgaard ..... 34/17
5,765,294 A * 6/1998 Puschnerat ..... 34/381
5,865,955 A * 2/1999 Ilvespaa et al. ..... 162/207
6,067,726 A * 5/2000 Rogne et al. ..... 34/268
6,190,162 B1 * 2/2001 Smith et al. ..... 431/328

* cited by examiner

*Primary Examiner*—Ira S. Lazarus
*Assistant Examiner*—K. B. Rinehart

(57) ABSTRACT

A combined infrared and hot air dryer includes a pressurized hood which is fed with combustion air through an air delivery duct. Each cross-direction zone of the hood includes a mixer. The air enters the mixer without any direct connection between the delivery duct and the mixer. Gas is supplied to each mixer from a gas manifold having a gas supply tube for each mixer. Excess air from the hood is fed through thin-walled tubes into the IR exhaust duct in a counter flow fashion to provide pre-heated clean air for air bars trailing the infrared zone.

19 Claims, 2 Drawing Sheets

INFRARED AND HOT AIR DRYER COMBINATION

BACKGROUND OF INVENTION

Gas fired infrared dryers and hot air dryers have been used successfully for many substrate drying and curing requirements for many years. Combinations of the two methods have also been utilized with some success. In these practices a substrate, which is usually a sheet of paper, is moved in proximity to the dryer so as to be subjected to a heated flow, such as from heated air, to dry the substrate and any coating on the substrate. Conventional air dryers are often started thirty or more minutes before start up because of thermal lag. This results in detrimental down time which could be quite costly, particularly over a long period of time.

SUMMARY OF INVENTION

An object of this invention is to provide an infrared and hot air dryer combination which utilizes the many advantages of an advanced IR (infrared) emitter to provide the best combination of the two technologies of gas fired infrared dryers and hot air dryers.

In accordance with this invention an IR emitter is provided which includes a pressurized hood having a series of gas infrared emitters mounted at the bottom of the hood disposed toward the path of flow of the moving substrate or paper sheet. The hood has an air inlet delivery duct attached at one or both ends and includes a mixer for each cross-direction zone. Gas is supplied to a header in the hood and then to each mixer to create a gas/air mixture which is fed to the infrared emitters. An exhaust chamber is mounted to and downstream from the hood. Air conveying tubes made of thin wall material extend from the hood into the exhaust chamber in a non-linear path which functions as a heat exchanger to quickly heat the air passing through the tubes. The tubes communicate with air bars downstream from the IR emitter to further dry the paper sheet.

THE DRAWINGS

Figure 1:
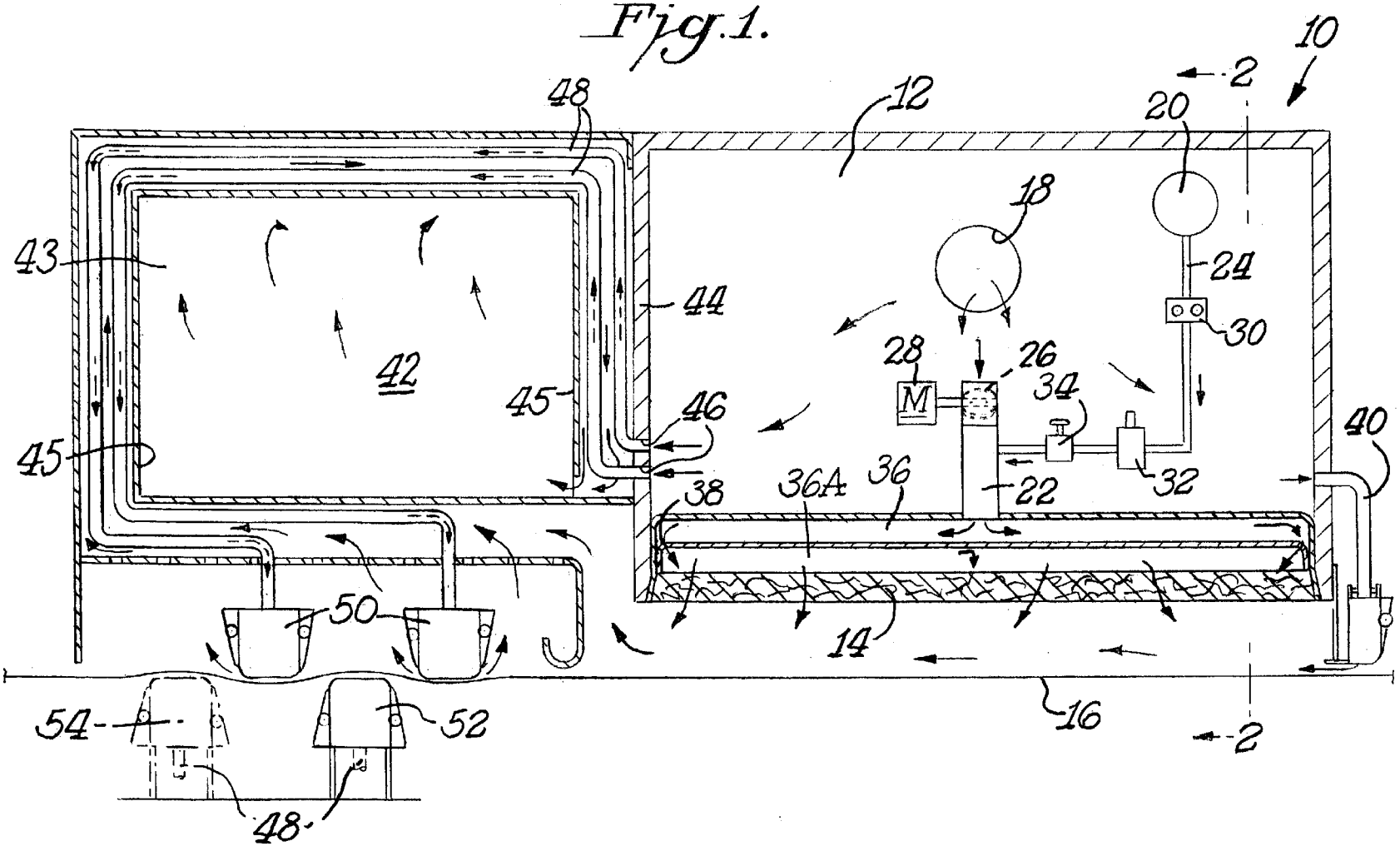
Figure 2:
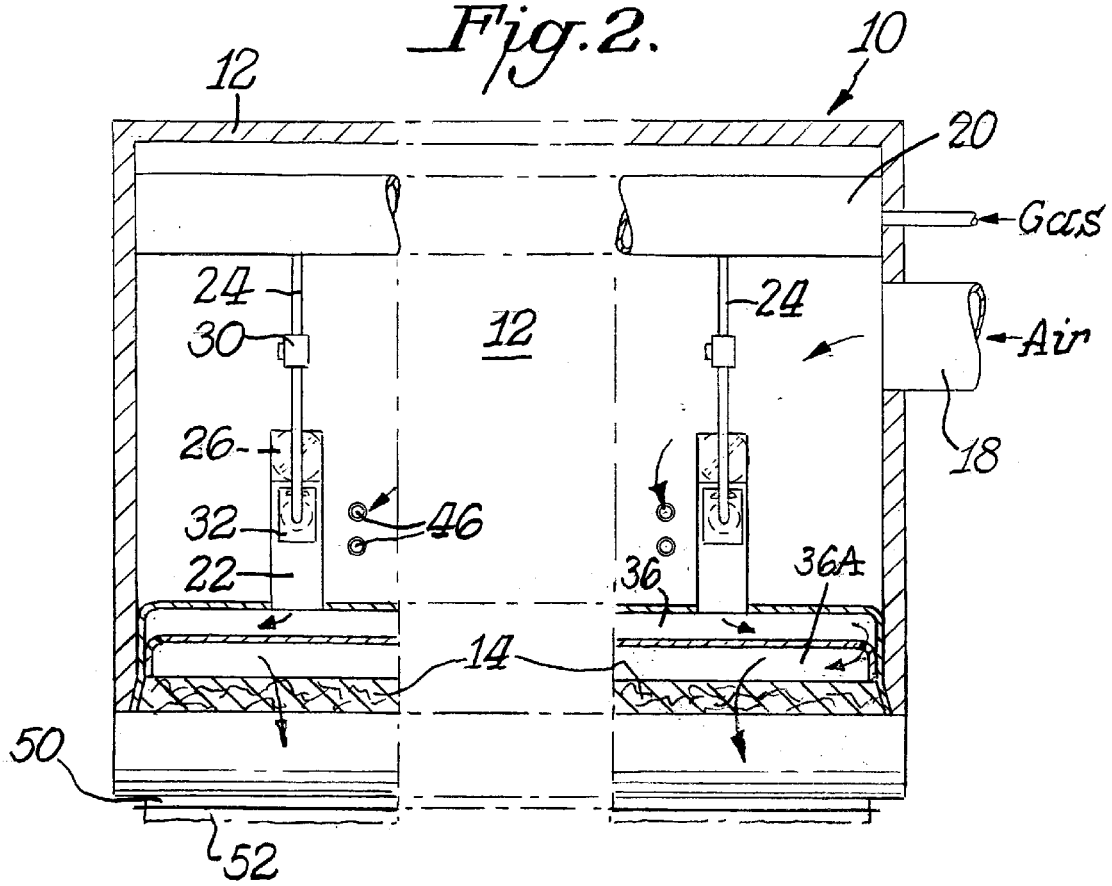

FIG. 1 is a front elevational view in cross-section showing an infrared and hot air dryer combination in accordance with this invention; and FIG. 2 is a cross-sectional side view of the combination shown in FIG. 1 taken along the line 2—2.

DETAILED DESCRIPTION

Infrared ("IR") dryers have long been used for treating substrates, such as in the drying of paper. Reference is made to U.S. Pat. Nos. 4,224,018, 4,326,843, 4,378,207, 4,416,618, 4,443,185, 4,447,205, 4,474,552, 4,500,283, 4,589,843, 4,604,054, 4,654,000, 4,722,681, 4,830,651, 5,024,596, 5,464,346 and 6,190,162, all of the details of which are incorporated herein by reference thereto.

The following description will be directed primarily to the features which differ from such known infrared dryers. As shown in FIGS. 1–2 an IR hood 10 includes a pressurized area 12. An infrared emitter 14 which could be of a construction as in the aforenoted patents is provided at the lower end of hood 10 to permit a gaseous combination of gas and air to pass through the matrix. As the mixture emerges the mixture is burned and flows below the matrix to the exhaust opening as indicated by the arrows in FIG. 1.

An air delivery duct 18 is located at one or both ends of hood 10 as best shown in FIG. 2. A gas manifold 20 extends the width of hood 10 as also shown in FIG. 2. Hood 10 may be considered as having at least one and usually a plurality of infrared zones disposed across its cross-direction. FIG. 2 illustrates two such zones, one at each end of the hood 10 with any number of intermediate zones. A mixer 22 is located in each of the zones. Air from the hood enters the mixer without any direct connection between the mixer 22 and the air delivery duct 18. Manifold 20 includes a gas delivery pipe 24 in each zone which communicates directly to its respective mixer 22 as illustrated.

Each mixer may be provided with a motor operated valve such as a butterfly valve 26 operated by motor 28 to control the flow of air into the mixer. Tubing 24 may be provided with an on/off control 30 and with a zero gas governor 32 which can permit individual cross-direction (cd) zone intensity modulation or a gas/air ratio giving maximum fuel efficiency. The zero gas governor 32 sets the desired flow through tube 24. Tube 24 may also be provided with an adjustment valve 34 to permit fine tuning or more precise adjustment of the flow.

The gas/air mixture exits from mixer 22 into passageway 36, through holes 38, into passageway 36A and then through matrix 14. Air is also discharged through passage 40 to form sweep air across paper sheet 16 as indicated by the arrows.

An exhaust chamber 42 is provided downstream from pressurized hood 10 with a common connecting bulkhead 44. Bulkhead 44 includes a plurality of openings 46 to permit the air to pass from hood 10 into exhaust chamber 42. If desired, a slidable plate may be mounted to bulkhead 44 to selectively open and close some or all of the openings 46. Each opening 46 may communicate with a thin-walled tube 48 so-that excess air from the pressurized hood 10 can be fed into the IR exhaust duct or chamber 42. Preferably, the thin-walled tubes 48 have a thickness of about 20 mil to provide low mass for rapid heating of excess air. The tubes 48 take a non-linear or convoluted path within exhaust duct 42.

As also shown in FIG. 1 the exhaust chamber 42 includes a ramp 43 which is inclined from the front toward the back of the exhaust chamber 42 to equalize the exhaust velocity improving cross direction exhaust flow uniformity. In addition, the air being so directed would maintain the walls 45 of the exhaust at an elevated temperature which assists in heating the thin-walled delivery tubes 48.

The arrangement of the invention provides a heat exchanger design to deliver the air to a set of air bars 50, 50 located above paper sheet 16. The pair of upper air bars are spaced apart a sufficient distance so that a lower air bar 52 may be disposed between, but below the upper air bars 50, 50. The upper surface of lower air bar 52 is positioned with respect to the lower surface of each upper air bar 50 such that the sheet 16 takes an S-type path as it passes between the air bars.

In one embodiment shown only a single lower air bar 52 is included in the assembly. Air bar 52 is larger than upper air bars 50 and functions to support the sheet by ambient air. The upper air bars 50, however, are fed with the hot air from tubes 48, 48 to heat the sheet 16.

FIG. 1 illustrates in phantom an alternative practice of the invention where a second lower air bar 54 is provided so that one of the upper air bars 50 is located between and above the lower air bars 52, 54. This would be the normal configuration if FIG. 1 were a mirror image on both sides of the paper sheet. This creates still a further S-path for the sheet.

The assembly of this invention may thus be practiced by providing excess air from the pressurized hood 10 which is fed through thin-walled tubes 48 into the IR exhaust duct 42 in counter flow fashion to the air entering the duct shown by the arrows in FIG. 1. This provides pre-heated clean air for air bars 50, 50 trailing the infrared zone.

The design of this invention offers many important advantages. For example, the IR exhaust 42 contains some water (steam) formed by combustion and significant water (steam) evaporated by the IR. By exchanging the heat from this exhaust to clean filtered air from the pressurized hood the air bars can operate at maximum efficiency because of the low humidity air provided.

By utilizing exhaust heat, which is normally wasted, the total system fuel efficiency is improved to 65% or more.

It is desirable to aerate the substrate or paper 16 between exposures to the intense IR zones to allow the sheet to breathe and for internal moisture to move to the surface. This helps prevent overdrying the sheet surface that can cause browning or burning of the surface.

The novel heat exchanger design delivers the air to the air bars very quickly and the low thermal mass of the air delivery tubes 48 insures rapid heat up. This means the whole system is up to temperature within about 15 seconds. Conventional air dryers are often started 30 or more minutes before start-up because of thermal lag.

If desired, the air bars could be coupled with advanced fiber matrix IR emitters such as disclosed in U.S. Pat. No. 6,190,162 to provide virtually instant on.

Utilizing the exhaust from the fiber matrix emitter eliminates the separate direct fired-gas burner normally supplied to the air bars. This totally eliminates polluting $NO_x$ or CO emissions. The increased efficiency of the combined system also reduces $CO_2$ emissions.

The system 10 can be installed with a mirror image with two bottom or lower air bars offset as the singular air bar in the one side IR version. This doubles the power density for sheets coated on two sides or for increased drying speed.

The air bars also provide stabilization of the sheet by virtue of the sine wave or S-curve imparted into the sheet by the air bars. This also helps to remove wrinkles.

By supplying combustion air to the gas/air mixers without a connecting pipe, assembly cost is reduced and emitter replacement is aided. Thus, the hood 10 is pressurized with finely filtered combustion air which enters the mixers within the hood without any direct connection between the mixers and the air delivery duct.

What is claimed is:

1. An infrared and hot air dryer combination comprising a pressurized hood, a matrix mounted at the bottom of said hood, an air delivery duct communicating with said hood, said hood having at least one infrared zone disposed across said hood in the cross direction, each zone having a mixer, a gas supply communicating with said mixer for creating a gas/air mixture from said mixer to be fed to and through said matrix to a substrate passing below said matrix, an exhaust chamber mounted to and downstream from said hood, air delivery tubes extending from said hood and disposed in said exhaust chamber, said exhaust chamber and said air delivery tubes comprising a heat exchanger to rapidly heat the air in said tubes, a pair of upper air bars disposed at said exhaust chamber downstream from said matrix, said upper air bars being supplied with heating air from said delivery tubes, and a lower air bar disposed below and between said upper air bars whereby a paper sheet passes below said upper air bars and above said lower air bar to be subjected to further drying.

2. The combination of claim 1 wherein said hood includes a plurality of cross-direction zones, said gas supply comprising a manifold extending across said zones, and a gas supply tube communicating with said manifold in each of said zones and communicating with said mixer in each of said zones.

3. The combination of claim 2 wherein said air delivery duct communicates with said hood at a location remote from said mixers whereby air is supplied to said mixers through an open space between said duct and said mixers.

4. The combination of claim 1 wherein said lower air bar is larger than said upper air bars and said lower air bar having ambient air.

5. The combination of claim 1 wherein said lower air bar is a first lower air bar, a further lower air bar being located spaced from said first lower air bar with one of said upper air bars disposed between and above said first lower air bar and said further lower air bar.

6. The combination of claim 5 wherein said lower air bars are fed with air from said delivery tubes.

7. An infrared and hot air dryer combination comprising a pressurized hood, a matrix mounted at the bottom of said hood, an air delivery duct communicating with said hood, said hood having at least one infrared zone disposed across said hood in the cross direction, each zone having a mixer, a gas supply communicating with said mixer for creating a gas/air mixture from said mixer to be fed to and through said matrix to a substrate passing below said matrix, an exhaust chamber mounted to and downstream from said hood, air delivery tubes extending from said hood and disposed in said exhaust chamber, a pair of upper air bars disposed at said exhaust chamber downstream from said matrix, said upper air bars being supplied with heating air from said delivery tubes, a lower air bar disposed below and between said upper air bars whereby a paper sheet passes below said upper air bars and above said lower air bar to be subjected to further drying, and said air delivery duct communicating with said hood at a location remote from said mixers whereby air is supplied to said mixers through an open space between said duct and said mixers.

8. The combination of claim 7 wherein each of said gas delivery tubes includes a zero gas governor.

9. The combination of claim 8 wherein each of said gas delivery tubes includes an on/off control and an adjustment valve, and each of said mixers includes a motor operated valve for controlling the intake of air into said mixer.

10. The combination of claim 7 wherein said air conveying tubes are made of thin-walled material, and said air conveying tubes extending in a non-linear path in said exhaust chamber to provide a heat exchanger for rapidly heating the air in said delivery tubes.

11. The combination of claim 10 wherein said delivery tubes are disposed in a tortuous path within said exhaust chamber.

12. The combination of claim 11 wherein said hood and said exhaust chamber are connected to each other by a common bulkhead, said delivery tubes being mounted to said bulkhead, and said delivery tubes having a wall thickness of about 20 mil.

13. The combination of claim 11 wherein said upper and lower air bars are disposed with respect to each other to cause the substrate to move in an S-path in the location of said air bars.

14. The combination of claim 13 wherein said lower air bar is larger than said upper air bars, and said lower air bar having ambient air.

15. The combination of claim 13 wherein said lower air bar is a first lower air bar, a further lower air bar being located spaced from said first lower air bar with one of said upper air bars disposed between and above said first lower air bar and said further lower air bar.

16. The combination of claim 15 wherein said lower air bars are fed with air from said delivery tubes.

17. An infrared and hot air dryer combination comprising a pressurized hood, a matrix mounted at the bottom of said hood, an air delivery duct communicating with said hood, said hood having at least one infrared zone disposed across said hood in the cross direction, each zone having a mixer, a gas supply communicating with said mixer for creating a gas/air mixture from said mixer to be fed to and through said matrix to a substrate passing below said matrix, an exhaust chamber mounted to and downstream from said hood, air delivery tubes extending from said hood and disposed in said exhaust chamber, a pair of upper air bars disposed at said exhaust chamber downstream from said matrix, said upper air bars being supplied with heating air from said delivery tubes, a lower air bar disposed below and between said upper air bars whereby a paper sheet passes below said upper air bars and above said lower air bar to be subjected to further drying, and said air conveying tubes are made of thin-walled material, and said air conveying tubes extending in a circuitous path in said exhaust chamber to provide a heat exchanger for rapidly heating the air in said delivery tubes.

18. The combination of claim 17 wherein said delivery tubes are disposed in a tortuous path within said exhaust chamber.

19. A method of drying a moving substrate through use of an infrared and hot air dryer combination comprising feeding combustion air into a pressurized hood from an air delivery duct, feeding gas into a manifold in the pressurized hood with the gas being conveyed through a tube extending from the manifold to a mixer in each cross-direction zone of the hood, feeding the air into the mixer through open space between the mixer and the air delivery duct to create a gas/air mixture, feeding the gas/air mixture through a matrix, and against a substrate passing below the matrix feeding excess air from the pressurized hood into thin-walled tubes which extend in a circuitous path in an exhaust chamber mounted downstream from the hood to create a heat exchange effect to the air in the delivery tubes and thereby heat the air in the delivery tubes, feeding the heated air in the delivery tubes to a set of upper air bars disposed downstream from the hood, disposing a lower air bar below and between the upper air bars, and passing the substrate between the upper and lower air bars.

* * * * *